US008953959B2

(12) United States Patent
Saeki

(10) Patent No.: US 8,953,959 B2
(45) Date of Patent: Feb. 10, 2015

(54) PRINTING APPARATUS

(71) Applicant: Masahito Saeki, Nagoya (JP)

(72) Inventor: Masahito Saeki, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/010,821

(22) Filed: Aug. 27, 2013

(65) Prior Publication Data

US 2014/0064766 A1 Mar. 6, 2014

(30) Foreign Application Priority Data

Aug. 30, 2012 (JP) ..... 2012-190081

(51) Int. Cl.
*G03G 15/00* (2006.01)
*G03G 21/20* (2006.01)
*G03G 15/20* (2006.01)

(52) U.S. Cl.
CPC ..... *G03G 15/2039* (2013.01); *G03G 21/20* (2013.01); *G03G 15/2046* (2013.01); *G03G 15/5045* (2013.01)
USPC ..... 399/43; 399/94

(58) Field of Classification Search
CPC ..... G03G 15/5045; G03G 21/20
USPC ..... 399/43, 94
See application file for complete search history.

(56) References Cited

U.S. PATENT DOCUMENTS

| | | | | |
|---|---|---|---|---|
| 5,907,740 | A * | 5/1999 | Nozawa | 399/43 |
| 2010/0239277 | A1 | 9/2010 | Mohri et al. | |
| 2010/0266301 | A1* | 10/2010 | Ohshika | 399/43 |
| 2012/0092703 | A1* | 4/2012 | Kawamata et al. | 358/1.15 |
| 2013/0011150 | A1* | 1/2013 | Lee et al. | 399/43 |
| 2014/0064753 | A1* | 3/2014 | Saeki | 399/43 |

FOREIGN PATENT DOCUMENTS

| | | | |
|---|---|---|---|
| JP | 2005-091556 | A | 4/2005 |
| JP | 2009-031580 | A | 2/2009 |
| JP | 2010-244032 | A | 10/2010 |

* cited by examiner

*Primary Examiner* — Walter L Lindsay, Jr.
*Assistant Examiner* — Rodney Bonnette
(74) *Attorney, Agent, or Firm* — Scully, Scott, Murphy & Presser, P.C.

(57) ABSTRACT

A printing apparatus includes: a printing device configured to print an image on a sheet; a temperature detector configured to detect a temperature in the printing apparatus; and a controller. The controller executes: a first processing in which the controller changes a first indicator based on printing performed by the printing device; a second processing in which the controller changes the first indicator based on a first temperature detected by the temperature detector at a first point in time and a second temperature detected by the temperature detector at a second point in time; and a third processing in which the controller suppresses a rise in the temperature in the printing apparatus when the first indicator reaches a predetermined value.

12 Claims, 5 Drawing Sheets

FIG.5

| Tb[℃] / Ta[℃] | RANGE A ～20[℃] | RANGE B 21～39[℃] | RANGE C 40～46[℃] | RANGE D 47～51[℃] | RANGE E 52～59[℃] | RANGE F 60～69[℃] | RANGE G 70～89[℃] | RANGE H 90[℃]～ |
|---|---|---|---|---|---|---|---|---|
| ～35[℃] | 0 | 0 | 0 | 0 | 0 | 0 | 0 | 0 |
| 36～46[℃] | 30 | 0 | 0 | 0 | 0 | 0 | 0 | 0 |
| 47～51[℃] | 45 | 15 | 0 | 0 | 0 | 0 | 0 | 0 |
| 52～59[℃] | 50 | 20 | 5 | 0 | 0 | 0 | 0 | 0 |
| 60～69[℃] | 55 | 25 | 10 | 5 | 0 | 0 | 0 | 0 |
| 70～89[℃] | 60 | 30 | 15 | 10 | 5 | 0 | 0 | 0 |
| 90～119[℃] | 65 | 35 | 20 | 15 | 10 | 5 | 0 | 0 |
| 120[℃]～ | 70 | 40 | 25 | 20 | 15 | 10 | 5 | 0 |

PRINTING APPARATUS

CROSS REFERENCE TO RELATED APPLICATION

The present application claims priority from Japanese Patent Application No. 2012-190081, which was filed on Aug. 30, 2012, the disclosure of which is herein incorporated by reference in its entirety.

BACKGROUND OF THE INVENTION

1. Field of the Invention

The present invention relates to a printing apparatus.

2. Description of the Related Art

There is known a technique for determining a permissible printing number (that is the number of sheets permitted to be printed), by referring to a table on the basis of a temperature sensed by a temperature sensor of a fuser. In this technique, when the cumulative number of printed sheets exceeds the permissible printing number, intermittent printing is performed, and when the temperature sensed by the temperature sensor lowers to a temperature equal to or lower than a predetermined temperature, the cumulative number of printed sheets is reset, and a normal printing operation is restarted.

SUMMARY OF THE INVENTION

However, the number of printed sheets not causing the temperature to exceed a permissible temperature varies depending on whether the temperature is sensed during its rising or lowering. Thus, if the permissible printing number is determined based on a temperature at a single point in time, productivity of printing may lower.

This invention has been developed to provide a technique of suppressing an excessive rise of a temperature in an apparatus and preventing a lowering in productivity of printing.

The present invention provides a printing apparatus including: a printing device configured to print an image on a sheet; a temperature detector configured to detect a temperature in the printing apparatus; and a controller configured to execute: a first processing in which the controller changes a first indicator based on printing performed by the printing device; a second processing in which the controller changes the first indicator based on a first temperature detected by the temperature detector at a first point in time and a second temperature detected by the temperature detector at a second point in time; and a third processing in which the controller suppresses a rise in the temperature in the printing apparatus when the first indicator reaches a predetermined value.

BRIEF DESCRIPTION OF THE DRAWINGS

The objects, features, advantages, and technical and industrial significance of the present invention will be better understood by reading the following detailed description of embodiments of the invention, when considered in connection with the accompanying drawings, in which:

FIG. 5 is a correlation table in which temperatures Ta, Tb and additional values for a counter are associated with each other.

DETAILED DESCRIPTION OF THE EMBODIMENTS

One Embodiment

Hereinafter, there will be described one embodiment of the present invention by reference to FIGS. 1-5.

1. Structure of Printer

Figure 1:
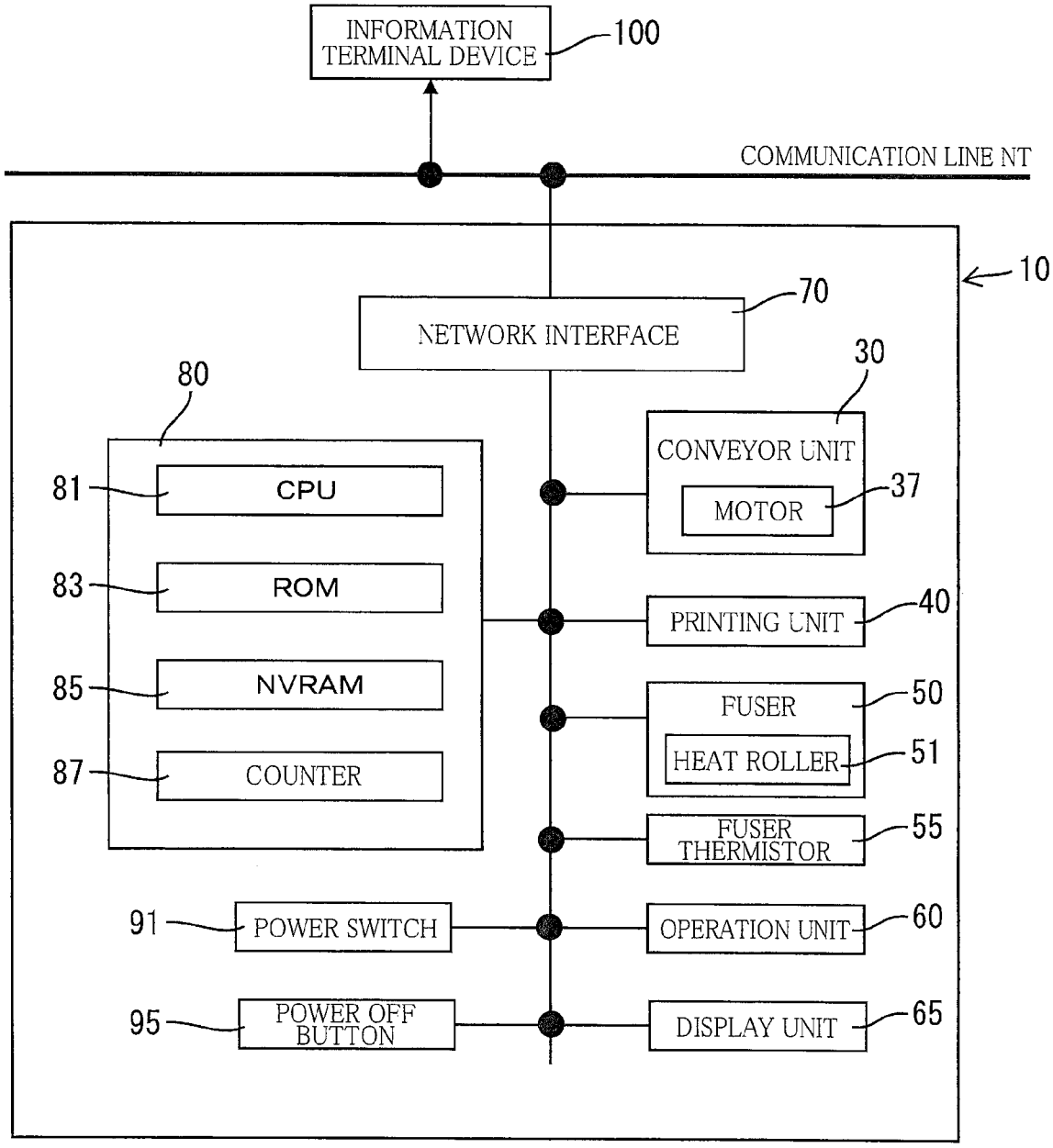
FIG. 1 is a block diagram illustrating an electric configuration of a printer according to one embodiment of the present invention.
Figure 2:
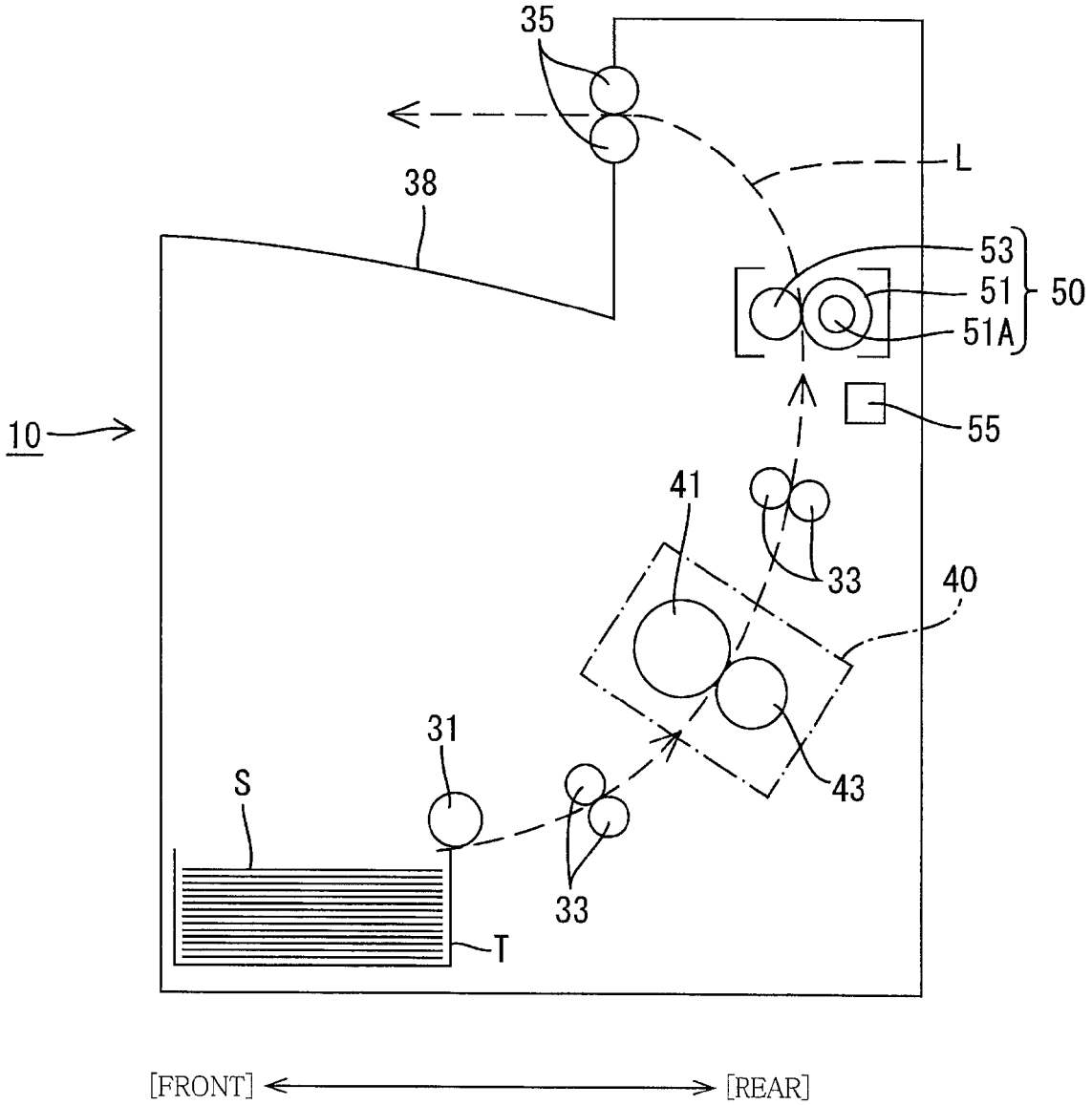
FIG. 2 is a cross-sectional view illustrating a main portion of the printer.

There will be explained a structure of a printer 10 with reference to FIGS. 1 and 2. The printer 10 includes a conveyor unit 30, a printing unit 40, a fuser (a fixing assembly) 50, a fuser thermistor 55, an operation unit 60, a display unit 65, a network interface 70, a controller 80, a power switch 91, and a power OFF button 95. The fuser thermistor 55 is one example of a temperature detector.

The conveyor unit 30 is configured to pick up sheets S (each as a recording medium) one by one from a tray T disposed in a lower portion of the printer 10 and convey the picked sheet S along a conveyance path L. The conveyor unit 30 includes: rollers such as a sheet-supply roller 31, conveyor rollers 33, and sheet-discharge rollers 35; and a motor 37 for rotating the rollers. The conveyor unit 30 is controlled by the controller 80 to convey the sheets S at the same speed regardless of the number of printing per unit time.

The printing unit 40 is configured to utilize electrophotography to print an image (a toner image) on the sheet S conveyed along the conveyance path L. The printing unit 40 includes a photoconductor drum 41, a charging unit (not shown), a developing roller (not shown), and a transfer roller 43.

The fuser 50 is disposed downstream of the printing unit 40 and includes a heat roller 51 and a pressure roller 53. The heat roller 51 includes a heater (heating element) 51A in the form of, e.g., a halogen lamp which generates heat when energized. The fuser 50 is configured to use heat to fix the printed image (toner image) to the sheet S while the rollers 51, 53 are conveying the sheet S. The sheet S on which the toner is fixed using heat is discharged by the sheet-discharge rollers 35 onto a sheet-output tray 38 provided in an upper portion of the printer 10. Provided near the heat roller 51 is the fuser thermistor 55 that detects a temperature of the heat roller 51. The controller 80 uses the detected temperature to control the temperature of the heat roller 51.

The operation unit 60 is provided with a plurality of buttons and allows a user to perform various input operations such as a command for printing on the sheet S. The display unit 65 includes a liquid crystal display and a lamp and displays, for example, various setting screens and an operation state of the printer 10. The network interface 70 is coupled by a communication line NT to an information terminal device 100 such as a personal computer and a facsimile machine, allowing data communication between the network interface 70 and the information terminal device 100. The power switch 91 is for turning on a power source of the printer 10, and the power OFF button 95 is for turning off the power source of the printer 10.

The controller 80 is configured to control the printer 10 and includes a CPU 81, a ROM 83, a non-transitory NVRAM 85, and a counter 87. The ROM stores various programs for controlling the printer 10, and the NVRAM 85 can store various data such as a count value of the counter 87. Upon receipt of a print job from the information terminal device 100, the CPU 81 of the controller 80 executes a print processing to print an image on the sheet S on the basis of print data.

2. Temperature-Rise Suppression Processing

The motor 37 is driven and generates heat in a printing operation on each sheet S. The motor 37 is operated more frequently with increase in the number of printed sheets or pages. Thus, the temperature in the printer 10 rises with the increase in the number of printed sheets. When the temperature in the printer 10 rises, a drum temperature of the photoconductor drum 41 and a toner temperature (i.e., a temperature of the toner) rise accordingly, which adversely affects image quality. To solve this problem, the rise of the temperature in the printer 10 is preferably suppressed. In the present printer 10, the counter 87 counts the number of printed sheets S, and when the count value reaches a threshold value as one example of a predetermined value, the controller 80 executes a temperature-rise suppression processing (as one example of a third processing) for suppressing the rise of the temperature in the printer 10. Specifically, the controller 80 executes an intermittent printing (S300-S340 in FIG. 7) in which printing is stopped for a predetermined length of time (30 seconds in this embodiment) each time when a predetermined number of sheets S are printed (five sheets in this embodiment). This processing can reduce the frequency of operations of the motor 37 to suppress the rise of the temperature in the printer 10.

3. Temperature-Rise Suppression Sequence

Figure 3:
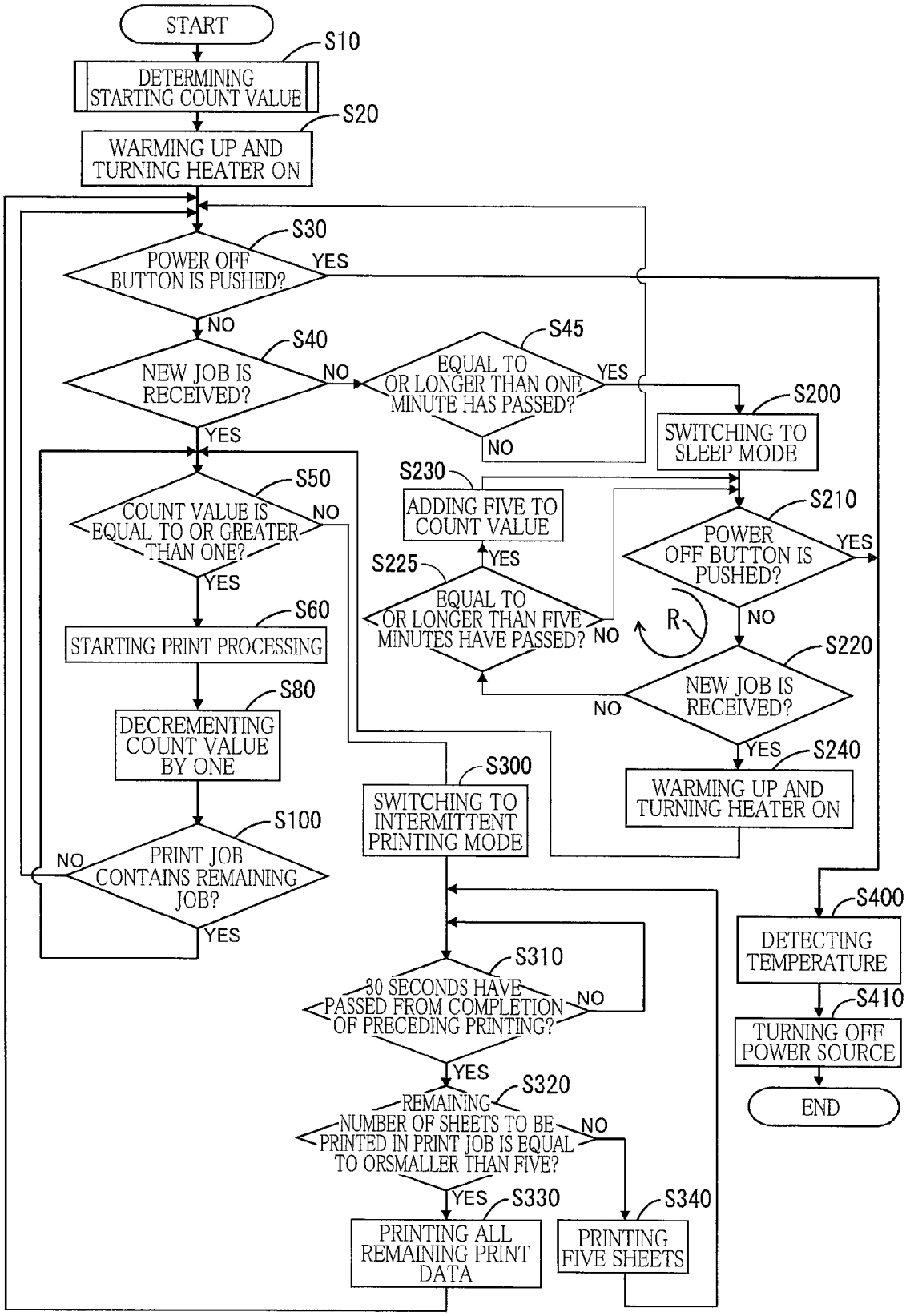
FIG. 3 is a flow chart illustrating a temperature-rise suppression sequence.

There will be next explained, with reference to FIG. 3, a temperature-rise suppression sequence which is executed by the controller 80. It is noted that the counter 87 takes on values from 0 to 150 in the present embodiment. Also, the counter 87 is of a countdown type and decrements the value (i.e., counter value) of the counter 87 by one each time when the sheet S is printed. The threshold value of the counter 87 is set at zero, and when the counter value of the counter 87 becomes zero as the threshold value, the controller 80 switches a mode of the printer 10 from a normal printing mode to an intermittent printing mode. Also, the mode of the printer 10 includes a sleep mode in addition to the normal printing mode and the intermittent printing mode. The sleep mode is a mode for reducing power consumption by supplying electric power only to the network interface 70 and the controller 80 and stopping supply of the electric power to the other devices.

The temperature-rise suppression sequence illustrated in FIG. 3 begins when the power switch 91 is turned on. At S10, the controller 80 executes a processing for determining a starting count value. The starting count value is an initial value of the counter 87 and set at 150 in the present embodiment.

At S20, the controller 80 controls the printing unit 40 to warm up. Specifically, the controller 80 rotates the photoconductor drum 41 and stirs the toner. Also, the controller 80 at S20 turns on the heater 51A incorporated in the heat roller 51 of the fuser 50. As a result, the temperature of the fuser 50 rises.

At S30, the controller 80 determines whether the user has pushed the power OFF button 95 or not. When the power OFF button 95 has not pushed, a negative decision (NO) is made at S30, and this sequence goes to S40. At S40, the controller 80 determines whether a new print job has been received or not. When no new print job has been received, a negative decision (NO) is made at S40, and this sequence goes to S45. At S45, the controller 80 determines whether equal to or longer than one minute has been passed from the warm-up operation. When equal to or longer than one minute has been passed, a positive decision (YES) is made, and this sequence goes to S200. When equal to or longer than one minute has not been passed, a negative decision (NO) is made, and this sequence returns to S30. On the other hand, when a new print job has been received, a positive decision (YES) is made at S40, and this sequence goes to S50. The following explanation is provided assuming that a new print job has been received. It is noted that, in a case where printing has already been performed after the power switch 91 is turned on the controller 80 at S45 determines whether or not equal to or longer than one minute has passed from the preceding printing.

At S50, the controller 80 determines whether or not the count value of the counter 87 is equal to or greater than one. In a case where a print job is received for the first time after the power switch 91 is turned on, a positive decision (YES) is made at S50 because the count value of the counter 87 is 150.

When the positive decision (YES) is made at S50, this sequence goes to S60 at which the print processing is started. As a result, a first sheet S is picked up from the tray T and supplied to a downstream side along the conveyance path L. The supplied sheet S passes through the printing unit 40 and the fuser 50 in order, and an image based on the print data is printed on the sheet S. The sheet S is then discharged onto the sheet-output tray 38 by the sheet-discharge rollers 35.

At S80, the controller 80 decrements the count value of the counter 87 by one. As a result, the count value of the counter 87 is changed from 150 to 149. It is noted that the processing at S80 is one example of a first processing for changing a first indicator in response to the execution of the printing.

Then at S100, the controller 80 determines whether or not the print job contains a remaining job, i.e., print data corresponding to second and/or subsequent sheets S. When the print job contains the print data corresponding to the second and/or subsequent sheets S, a positive decision (YES) is made at S100. In this case, this sequence goes to S50 at which the controller 80 again determines whether or not the count value of the counter 87 is equal to or greater than one. In a stage in which only one sheet has been printed after the power switch 91 is turned on, the count value of the counter 87 is 149. Thus, the positive decision (YES) is made at S50.

When the positive decision (YES) is made at S50, this sequence goes to S60 at which the print processing is started for the second sheet S, and this sequence goes to S80. At S80, the controller 80 decrements the count value of the counter 87 by one. As a result, the count value of the counter 87 is changed from 149 to 148.

Then at S100, the controller 80 determines whether or not the print job contains a remaining job, i.e., print data corresponding to third and/or subsequent sheets S. When the print job contains the print data corresponding to the third and/or subsequent sheets S, the positive decision (YES) is made at S100. Thereafter, when the positive decision (YES) is made at S50, this sequence goes to S60 at which the print processing is started for the third sheet S, and this sequence goes to S80. At S80, the controller 80 decrements the count value of the counter 87 by one. As a result, the count value of the counter 87 is changed from 148 to 147.

In this printer 10 as described above, the count value of the counter 87 is decremented by one each time when the sheet S is printed.

When the print processing is completed for all the print data contained in the print job, a negative decision (NO) is made at S100 upon the execution of the processing at S100. When the negative decision (NO) is made at S100, this sequence returns to S30 at which the controller 80 determines whether the user has pushed the power OFF button 95 or not.

When the user has not pushed the power OFF button 95, the controller 80 at S40 determines whether a print job has been received or not within one minute before this determination.

When a print job has been received, the processings at S50 and subsequent steps are executed to execute the print processing. In a case where the controller 80 has executed a print processing for a print job containing image data representative of a lot of pages, or a plurality of print processings for print jobs each received within one minute from the preceding one of the print jobs, the value of the counter 87 is decremented and becomes zero. In this case, a negative decision (NO) is made at S50 upon the execution of the processing at S50, and the mode of the printer 10 is switched to the intermittent printing mode.

The intermittent printing mode is a mode for intermittently performing the printings on the sheets S. In the present embodiment, the motor 37 is stopped for 30 seconds each time when fives sheets S are printed. Specifically, the intermittent printing mode is composed of processings at S310-S340. First at S310, the controller 80 determines whether or not equal to or longer than 30 seconds have passed from completion of the preceding printing. When equal to or longer than 30 seconds have passed from the completion of the preceding printing, this sequence goes to S320. On the other hand, when equal to or longer than 30 seconds have not passed from the completion of the preceding printing, the processing at S310 is repeated.

At S320, the controller 80 determines whether or not the remaining number of sheets to be printed based on the print data contained in the print job is equal to or smaller than five. When the remaining number of sheets to be printed is larger than five, a negative decision (NO) is made at S320, and this sequence goes to S340. At S340, the motor 37 starts to be rotated again, and when five sheets S are printed, the motor 37 is stopped again. This sequence then goes to S310 at which the controller 80 determines whether or not equal to or longer than 30 seconds have passed from completion of the preceding printing. A negative decision (NO) is made at S310 until equal to or longer than 30 seconds have passed from the completion of the preceding printing. During this period, the motor 37 is stopped. When equal to or longer than 30 seconds have passed from the completion of the preceding printing, a positive decision (YES) is made at S310, and this sequence goes to S320. At S320, the controller 80 determines whether or not the remaining number of sheets to be printed based on the print data contained in the print job is equal to or smaller than five. When the remaining number of sheets to be printed is larger than five, this sequence goes to S340 at which the motor 37 starts to be rotated again, and when five sheets S are printed, the motor 37 is stopped again. The processings described above are repeated, so that the motor 37 is stopped for 30 seconds each time when five sheets are printed.

When the remaining number of sheets to be printed based on the print data contained in the print job is equal to or smaller than five, a positive decision (YES) is made at S320, and this sequence goes to S330. At S330, the motor 37 starts to be rotated again to print all the remaining print data. As a result, printing of all the print data contained in the print job is finished. This sequence then returns to S30.

In the present printer 10 as described above, when the count value of the counter 87 becomes zero as the threshold value, the mode of the printer 10 is switched to the intermittent printing mode for intermittently performing printing. Since the motor 37 as a heat source can be stopped, the rise of the temperature in the printer 10 can be suppressed. It is noted that the processings at S300-S340 are one example of the temperature-rise suppression processing (an intermittent print processing in this embodiment).

There will be next explained a case where a print job has not been received within one minute after printing of all the print data contained in the print job is finished. When a print job has not been received within one minute, a negative decision (NO) is made at S40, a positive decision (YES) is made at S45, and this sequence goes to S200.

At S200, the mode of the printer 10 is switched to the sleep mode in which electric power is supplied only to the network interface 70 and the controller 80, and no electric power is supplied to the other devices such as the motor 37 and the heater 51A.

At S210, the controller 80 determines whether the user has pushed the power OFF button 95 or not. When the power OFF button 95 is not pushed, this sequence goes to S220. At S220, the controller 80 determines whether a new print job has been received or not. When no new print job has been received, a negative decision (NO) is made at S220. When the negative decision (NO) is made at S220, this sequence goes to S225 at which the controller 80 determines whether equal to or longer than five minutes have passed since the mode of the printer 10 is switched to the sleep mode. When equal to or longer than five minutes have passed, a positive decision (YES) is made at S225, and this sequence goes to S230. At S230, the controller 80 adds five to the count value of the counter 87. On the other hand, when a negative decision (NO) is made at S225, this sequence returns to S210. It is noted that, in a case where the count value of the counter 87 has already been incremented at S230 after the mode of the printer 10 is switched to the sleep mode, the controller 80 at S225 whether or not equal to or longer than five minutes have passed from the preceding increment of the count value.

In this processing, in a case where the count value of the counter 87 is 140, five added to the count value makes 145. In a case where the count value is 130, five added to the count value makes 135. It is noted that this addition is performed such that the count value does not exceed 150 as an upper limit value of the counter 87. That is, in a case where the count value is 147, three added to the count value makes 150.

This addition to the count value is performed for the following reason: when no print job has been received within five minutes after the mode of the printer 10 is switched to the sleep mode, the motor 37 and the heater 51A are continuously stopped for equal to or longer than five minutes, making it possible to assume that the temperature in the printer 10 has been lowered after the switch to the sleep mode even if the temperature in the printer 10 had risen with printing before the switch to the sleep mode.

When the controller 80 at S230 adds five to the count value of the counter 87, this sequence returns to S210. Accordingly, a loop R (illustrated in FIG. 3) for repeating the processings at S210, S220, S225, and S230 is made. This loop exits when the power OFF button 95 is pushed (S210: YES) or when a print job is received (S220: YES). In this loop, five is added to the count value of the counter 87 until the count value reaches the upper limit value "150", each time when five minutes passes after the mode of the printer 10 is switched to the sleep mode.

When the printer 10 receives a print job sent from the information terminal device 100, the sleep mode ends, and this sequence goes to the print processing. That is, a positive decision (YES) is made at S220, so that the loop R illustrated in FIG. 3 exits, and this sequence goes to S240. At S240, as in the processing at S20, the controller 80 controls the printing unit 40 to warm up. The controller 80 then executes processings at S50 and subsequent steps. When the power OFF button 95 is pushed by the user, on the other hand, a positive decision (YES) is made at S30 or S210, and this sequence goes to S400. At S400, the controller 80 executes a processing (which will be described below) for detecting the temperature of the heat roller 51, and this sequence goes to S410. At S410, the controller 80 turns off the power source, and the temperature-rise suppression sequence ends.

In the present embodiment, when the power source is turned off, the count value of the counter 87 is stored into the NVRAM 85, and when the printer 10 is thereafter turned on, the count value stored in the NVRAM 85 is used or migrated. In case where the power source is in the OFF state for a relatively long time, however, it is assumed that the temperature in the printer 10 has been lowered. Thus, if the previous count value is used at the next operation, there is a case in which even though the temperature in the printer 10 does not rise greatly, the count value becomes zero, and the intermittent printing is frequently performed.

To solve this problem, in the present embodiment, the starting count value of the counter 87 is set or obtained by adding, to the count value stored in the NVRAM 85, an additional value related to a length of time for which the power source is estimated to be in the OFF state. It is noted that, since the printer 10 cannot detect the length of time for which the power source is estimated to be in the OFF state, the printer 10 estimates the length of time on the basis of (i) a temperature Ta of the heat roller 51 at a time just before the power source is turned off and (ii) a temperature Tb of the heat roller 51 at a time just after the power source is turned on.

Specifically, when the power OFF button 95 is pushed, the positive decision (YES) is made at S30 or S210, and this sequence goes to S400 as described above. At S400, the CPU 81 turns off the fuser 50 (that is, the CPU 81 de-energizes the heat roller 51) and detects the temperature Ta of the heat roller 51 after the de-energization on the basis of a detection value of the fuser thermistor 55. The detected temperature Ta of the heat roller 51 is stored into the NVRAM 85 together with the count value of the counter 87. The power source of the printer 10 is then turned off. In this way, the temperature Ta of the heat roller 51 just before the power source is turned off can be stored into the NVRAM 85.

When the power switch 91 is thereafter turned on by, e.g., the user, the printer 10 is turned on. After the printer 10 is turned on, the temperature-rise suppression sequence begins with S10 at which the controller 80 executes the processing for determining the starting count value.

Figure 4:
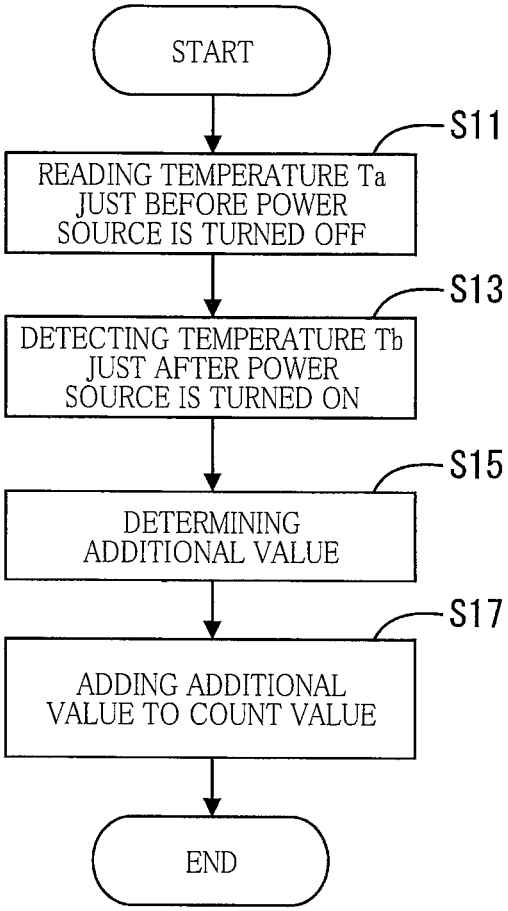
FIG. 4 is a flow chart illustrating a processing for determining a starting count value.

The processing for determining the starting count value is composed of processings at S11-S17 illustrated in FIG. 4. First at S11, the CPU 81 of the controller 80 reads from the NVRAM 85 the temperature Ta of the heat roller 51 just before the power source is turned off. At S13, the CPU 81 detects the temperature Tb of the heat roller 51 just after the power source is turned on, on the basis of the detection value of the fuser thermistor 55. It is noted that the temperature Tb is detected in a state in which the heat roller 51 is not energized, that is, the heat roller 51 is in the OFF state.

At S15, the additional value of the counter 87 is determined by referring to a correlation table illustrated in FIG. 5. In the correlation table, the temperature Tb just after the power source is turned on is divided into eight ranges A-H, and the temperature Ta just before the power source is turned off is also divided into eight ranges. Additional values of the counter 87 are associated or set respectively for combinations of the ranges A-H of the temperature Tb and the ranges of the temperature Ta. For example, in a case where the temperature Ta read at S11 is 50° C., the temperature Tb read at S13 is 25° C., the additional value is "15".

The additional values stored in the correlation table are set such that the additional value increases with an increase in a difference between the temperature Ta and the temperature Tb (Ta−Tb), that is, an increase in a length of time of the OFF state of the power source. Thus, the additional value can be set at a large value depending upon the length of time of the OFF state of the power source. It is noted that the correlation table is created on the basis of, e.g., data obtained by experiment for measuring how the temperature of the heat roller 51 being heated changes with a lapse of time. The correlation table is stored in the NVRAM 85 in the present embodiment. The correlation table is one example of a table.

At S17, the controller 80 reads the count value of the counter 87 from the NVRAM 85. The controller 80 also adds the additional value determined at S15 to the read count value. As a result, the starting count value, i.e., the initial value, of the counter 87 is determined. For example, in a case where the read count value is "100", the additional value "15" is added. As a result, the starting count value of the counter 87 is determined at "115" by addition of the additional value "15" to the count value "100" at a point in time when the power source is turned off. It is noted that the processings S11-S17 are one example of a second processing. Also, the additional value is one example of a changing amount (i.e., a scale value).

In the present embodiment as described above, the additional value related to the length of time for which the power source is in the OFF state is added to the starting count value of the counter 87. Thus, the number of sheets printed before the intermittent printing can be the appropriate number of sheets related to the length of time for which the power source is in the OFF state. This configuration can suppress excessive rise of the temperature in the printer 10, preventing lowering of productivity of the printing.

In the present embodiment, the additional value is determined based on the correlation table. This configuration reduces a load on the CPU 81 when compared with a case where the additional value is obtained by calculation. Also, in the present embodiment, the already-existing fuser thermistor 55 used for controlling the temperature of the fuser 50 detects the temperature Ta of the heat roller 51 (or in the printer 10) just before the power source is turned off and the temperature Tb of the heat roller 51 (or in the printer 10) just after the power source is turned on. To detect the temperature in the printer 10, a temperature detector specific to that detection may be provided. However, the already-existing fuser thermistor 55 is used to detect the temperature in the present embodiment, resulting in a fewer number of components and reduced cost.

Also, in the present embodiment, the temperature Ta just before the power source is turned off and the temperature Tb just after the power source is turned on are measured in the state in which the heat roller 51 of the fuser 50 is in the OFF state. This measurement can accurately detect the change in the temperature with the lapse of time. Thus, the length of time for which the power source is in the OFF state can be accurately estimated.

Other Embodiments

While the embodiment of the present invention has been described above, it is to be understood that the invention is not limited to the details of the illustrated embodiment, but may be embodied with various changes and modifications, which may occur to those skilled in the art, without departing from the spirit and scope of the invention. For example, the following embodiments also fall within the scope of the present invention.

(1) In the above-described embodiment, the additional value of the counter 87 is determined based on the temperature Ta just before the power source is turned off and the temperature Tb just after the power source is turned on. Nevertheless, the present invention is not limited to this configuration as long as an changing amount (an additional value and/or a reduction value) for the counter 87 is determined based on temperatures in the apparatus (i.e., the printer 10) at two points in time. That is, the apparatus may be configured to measure temperatures therein at two points in time with a time interval therebetween within a period for which the power source is in an ON state and increase or reduce the count value of the counter 87 on the basis of a difference between the obtained temperatures.

It is possible to estimate that, during lowering of the temperature in the apparatus, a larger number of sheets can be printed before the temperature in the apparatus reaches a permissible temperature than during rise of the temperature in the apparatus. Thus, in a case where the difference between the temperatures at two points in time indicates that the temperature in the apparatus is lowering, the number of sheets printable before the temperature in the apparatus reaches the threshold value can be increased by increasing or reducing the count value of the counter 87 such that the count value is brought farther from the threshold value. On the other hand, in a case where the difference between the temperatures at two points in time indicates that the temperature in the apparatus is rising, the number of sheets printable before the temperature in the apparatus reaches the threshold value can be reduced by increasing or reducing the count value of the counter 87 such that the count value is brought closer to the threshold value. In this configuration, the mode of the apparatus is switched to the intermittent printing mode early, whereby the temperature in the apparatus can be lowered before the temperature in the apparatus reaches the permissible temperature. It is noted that a component whose temperature is to be detected is not limited as long as the component is disposed in the apparatus, but the temperature detector is preferably configured to detect the drum temperature of the photoconductor drum 41 which greatly affects the image quality. Also, the timing for increasing or reducing the count value is not limited to the turning-on of the power source and may be within the period of the ON state of the power source. For example, the count value may be increased or reduced when the mode is switched.

Also, a temperature in the printer 10 may be measured at (i) a point in time when a print processing for a series of print jobs is finished and (ii) a point in time when a print processing for a next series of print jobs is started, for example, as the two points in time when the difference between the temperatures in the printer 10 is measured. Where the printer is thus configured, since the motor 37 is not driven for the print processing over a period between the two points in time, the temperature is expected to lower over the period between the two points in time, so that the count value of the counter 87 can be changed in a direction away from the threshold value. It is noted that even if the motor is driven in the period between the two points in time, the temperature may also lower in the period between the two points in time, and therefore the motor 37 may be driven in the period between the two points in time.

(2) In the above-described embodiment, the controller 80 is constituted by the single CPU 81, the ROM 83, the NVRAM 85, and other similar devices, but the controller 80 may include a plurality of CPUs 81. Also, the controller 80 may be constituted by a combination of the CPU 81 and a hardware circuit(s) such as an ASIC or only by a hardware circuit(s).

(3) In the above-described embodiment, one is reduced from the count value of the counter 87 each time when one sheet S is printed. Nevertheless, the counting may be performed in any manner as long as the counting is performed each time when the print processing is executed. For example, one may be reduced from the count value of the counter 87 each time when a plurality of sheets S, e.g., two sheets S, are printed. Also, the count value of the counter 87 may be incremented each time when the print processing is executed. In this configuration, the threshold value needs to be set at a value that is larger than the initial value of the counter 87. Also, instead of the configuration in which the counter 87 counts the number of the printed sheets, the temperature-rise suppression processing may be executed on the basis of a cumulative length of time that is obtained by accumulating driving times of the motor 37 (each of which is a length of time in which the motor 37 is driven) until the power OFF button 95 is pushed after the power switch 91 is pushed.

What is claimed is:

1. A printing apparatus comprising:

a printing device configured to print an image on a sheet;

a temperature detector configured to detect a temperature in the printing apparatus; and a controller configured to execute:

a first processing in which the controller changes a first indicator based on printing performed by the printing device;

a second processing in which the controller changes the first indicator based on a first temperature detected by the temperature detector at a first point in time and a second temperature detected by the temperature detector at a second point in time; and a third processing in which the controller suppresses a rise in the temperature in the printing apparatus when the first indicator reaches a predetermined value.

2. The printing apparatus according to claim 1, wherein the controller is configured to execute the second processing in which, when the temperature in the printing apparatus is lowering, the controller changes the first indicator to increase a difference between the first indicator and the predetermined value.

3. The printing apparatus according to claim 1, wherein the controller is configured to execute the second processing in which, when the temperature in the printing apparatus is rising, the controller changes the first indicator to reduce a difference between the first indicator and the predetermined value.

4. The printing apparatus according to claim 1, wherein the printing by the printing device is not performed in a period between the first point in time and the second point in time.

5. The printing apparatus according to claim 1, wherein the controller is configured to execute the first processing in which the controller changes the first indicator to reduce a difference between the first indicator and the predetermined value based on an increase in the number of sheets printed by the printing device.

6. The printing apparatus according to claim 5, wherein the controller is configured to execute the first processing in which the controller changes the first indicator to reduce the difference between the first indicator and the predetermined value in each increase in the number of sheets printed by the printing device.

7. The printing apparatus according to claim 1, wherein the controller is configured to execute the second processing in which the controller stores the first indicator at the first point in time, determines, based on the first temperature and the second temperature, a changing amount for changing the first indicator, and changes the stored first indicator at the first point in time by the determined changing amount.

8. The printing apparatus according to claim 1, wherein the first point in time is a point in time when a state of the printing apparatus is switched from an ON state to an OFF state, and wherein the second point in time is a point in time when the printing apparatus whose state has been switched to the OFF state at the first point is switched from the OFF state to the ON state.

9. The printing apparatus according to claim 8, wherein the controller is configured to execute the second processing in which the controller changes the first indicator based on a table that stores a changing amount for changing the first indicator, the changing amount being associated with the first temperature and the second temperature.

10. The printing apparatus according to claim 1, wherein the temperature detector is a fuser thermistor configured to detect a temperature of a fuser that is configured to fix the image printed on the sheet.

11. The printing apparatus according to claim 10, wherein each of the first temperature and the second temperature is a temperature of the fuser being in an OFF state.

12. The printing apparatus according to claim 1, wherein the controller is configured to execute the third processing in which the printing by the printing device is stopped for a predetermined period when the first indicator reached the predetermined value.

* * * * *